US005174230A

United States Patent [19]

Noguchi et al.

[11] Patent Number: 5,174,230

[45] Date of Patent: Dec. 29, 1992

[54] UPPER FEED DEVICE FOR SEWING MACHINE

[75] Inventors: Kazuo Noguchi; Akira Teranishi; Takashi Kasuda; Yoji Seto; Keiichi Aoki; Shozo Hikiguchi, all of Osaka, Japan

[73] Assignee: Pegasus Sewing Machine Mfg. Co., Ltd., Osaka, Japan

[21] Appl. No.: 731,736

[22] Filed: Jul. 16, 1991

[30] Foreign Application Priority Data

Jul. 17, 1990 [JP] Japan ..... 2-75635[U]
Jun. 26, 1991 [JP] Japan ..... 3-154405

[51] Int. Cl.[5] ..... D05B 27/06
[52] U.S. Cl. ..... 112/311; 112/313
[58] Field of Search ..... 112/311, 313, 312, 314, 112/320

[56] References Cited

U.S. PATENT DOCUMENTS

| | | | |
|---|---|---|---|
| 4,285,294 | 8/1981 | Aida | 112/320 X |
| 4,341,172 | 7/1982 | Thompson | 112/320 X |
| 4,417,536 | 11/1983 | Shiomi | 112/311 |
| 4,421,047 | 12/1983 | Alberti | 112/311 |
| 4,589,364 | 5/1986 | Yamamoto et al. | 112/311 |
| 4,594,958 | 6/1988 | Ide | 112/311 X |
| 4,759,304 | 7/1988 | Nava et al. | 112/311 |
| 4,978,843 | 1/1991 | Kasuda | 112/311 X |

FOREIGN PATENT DOCUMENTS 0326752 8/1989 European Pat. Off. .

*Primary Examiner*—Werner H. Schroeder
*Assistant Examiner*—Paul C. Lewis
*Attorney, Agent, or Firm*—Flynn, Thiel, Boutell & Tanis

[57] ABSTRACT

An upper feed device for a sewing machine comprises an upper feed arm having its base end coupled with a longitudinally swinging crank and an upper feed dog attached at its front end. The mechanism for vertically moving the upper feed arm consists of a clutch mechanism comprising a lever rotatably mounted on a vertical feed shaft and swinging in cooperation with the main shaft, an abutment disposed on the lever and an abutment of a collar disposed on the vertical feed shaft, which is capable of disconnecting the cooperation of the lever and the vertical feed shaft, and a crank having a roller slidably fitting with a guide disposed parallel to the upper feed arm and which moves vertically through its attachment to the vertical feed shaft. A block is provided below the roller to engage with the free lower end surface of the crank and is adjustable in its mounting position to prevent the roller from descending more than specified. The upper surface of the block engages with the free lower end surface of the crank and is inclined.

10 Claims, 5 Drawing Sheets

UPPER FEED DEVICE FOR SEWING MACHINE

BACKGROUND OF THE INVENTION

1. Field of the Invention

The present invention is directed to an upper feed device for a sewing machine and, more particularly, to an upper feed device for a sewing machine which feeds cloth by collaboration of an upper feed dog and a lower feed dog which make ellipsoidal motions in four directions consisting of longitudinal movements and vertical movements.

2. Description of the Prior Art

A known upper feed device for a sewing machine comprises a crank which swings longitudinally in cooperation with a main shaft, an upper feed arm which has a base portion which pivots rotatably on the crank in a vertical direction, an upper feed dog disposed at the free end of the upper feed arm and positioned opposite a lower feed dog, a spring device for pushing down the upper feed arm, and a crank which swings in the vertical direction in cooperation with the main shaft and moves the upper feed arm vertically while the upper feed arm is pushed down by the spring device. In U.S. Pat. No. 4 589 364, in the mechanism for moving the upper feed arm vertically, a clutch mechanism comprises an abutment on a collar affixed to a swinging shaft and an abutment on a lever rotatably disposed on the swinging shaft. Also, a roller which pivots on the crank pin of the crank and moves the upper feed arm vertically is fitted in the guide groove formed by the guide disposed below the upper feed arm.

In the above devices, during the descent of the upper feed dog to the bottom end point, where it engages with the cloth on the throat plate and further descent is prevented, the crank pin separates from the upper feed arm in the former type, or the abutment on the lever separates from the abutment on the collar in the latter type with the clutch mechanism, and the crank pin, separated from the upper feed arm, reaches the bottom end point and pivots reversibly and engages with and lifts the upper feed arm, or the abutment of the lever separates from the abutment of the collar and engages and lifts the upper feed arm, so that the upper feed dog rises above the cloth on the throat plate. In this manner, that is, while the upper feed dog is engaged with the cloth on the throat plate, cloth feeding is carried out.

FIG. 7 shows the track of the upper feed dog, in which the cloth is fed between point A, where the upper feed dog descends and engages with the cloth on the throat plate, and point B where it has ascended from the cloth on the throat plate. The horizontal line segment AB indicates the cloth feed amount. In FIG. 7, when it is attempted to feed the cloth at the position of line segment CD by lowering the position of the upper feed dog to engage with the cloth, the feed efficiency, that is, the cloth feed amount increases, but the cloth's engagement with the ascending lower feed dog becomes stronger, and the impulsive cloth gripping force is intensified and, as a result, the cloth is damaged by the biting of the upper and lower feed dogs.

To solve this problem, Japanese Laid-open Utility Model No. 63-55972 proposes the provision of a cam groove in a special shape and a leaf spring for the guide groove to engage with the crank pin in order to reduce the impulsive force, but the fabrication and processing of the cam groove are rather difficult.

SUMMARY OF THE INVENTION

It is hence a primary object of the present invention to present an upper feed device for a sewing machine which is capable of enhancing the feed efficiency of the upper feed dog in a simple structure and does not damage the cloth by the feed dogs.

The upper feed device of the invention is characterized by providing an upper feed arm, or an arbitrary member, a mechanism for vertically moving the upper feed arm and descent arresting means for preventing the upper feed dog from descending below a desired position, in which, as the upper feed dog moves ellipsoidally in four directions by longitudinal and vertical motions, the lower portion of the ellipsoidal track is cut off at a desired height by the descent arresting means so as to form a nearly horizontal line.

According to the upper feed device of the invention, aside from the improvement in the feed efficiency, since the upper feed dog is not lowered from a specified height if the feed efficiency is raised, an increase in the feed damage caused by an increase in the gripping force of the upper and lower feed dogs on the cloth may be prevented.

If the upper feed is not sufficient, due to the raising of the descent position of the upper feed dog, the upper feed dog affixed to the upper feed arm may be adjusted in its vertical position. As a result, without changing the descent position of the upper feed dog, or by freely adjusting its descent position, the lower portion of the ellipsoidal track may be cut to a desired height.

In a preferred embodiment, the descent arresting means is composed of a pin extending laterally below the upper feed arm, and it arrests the descent of the upper feed arm coming down along with the downward rotation of the crank. In this embodiment, it is desired to adjust the vertical position of the pin, so that the height of the descent position of the upper feed dog is adjusted, thereby varying the feed efficiency.

The descent arresting means in the upper feed device having a clutch mechanism disposed in the vertical motion mechanism of the upper feed dog is composed of a block installed below a roller pivotably mounted on the crank pin. This block preferably has its upper surface engaged with the roller and is inclined longitudinally. This longitudinal position is designed to be adjustable.

The descent arresting means in another preferred embodiment is composed of a stopper piece, supported on the sewing machine frame by a rod, which engages with the abutment on the collar composing the clutch mechanism affixed on the swinging shaft or the stopping means disposed on the swinging shaft. In this embodiment too, preferably, the position of the stopper piece is adjusted by varying the mounting position of the rod.

DESCRIPTION OF THE PREFERRED EMBODIMENTS

Figure 1:
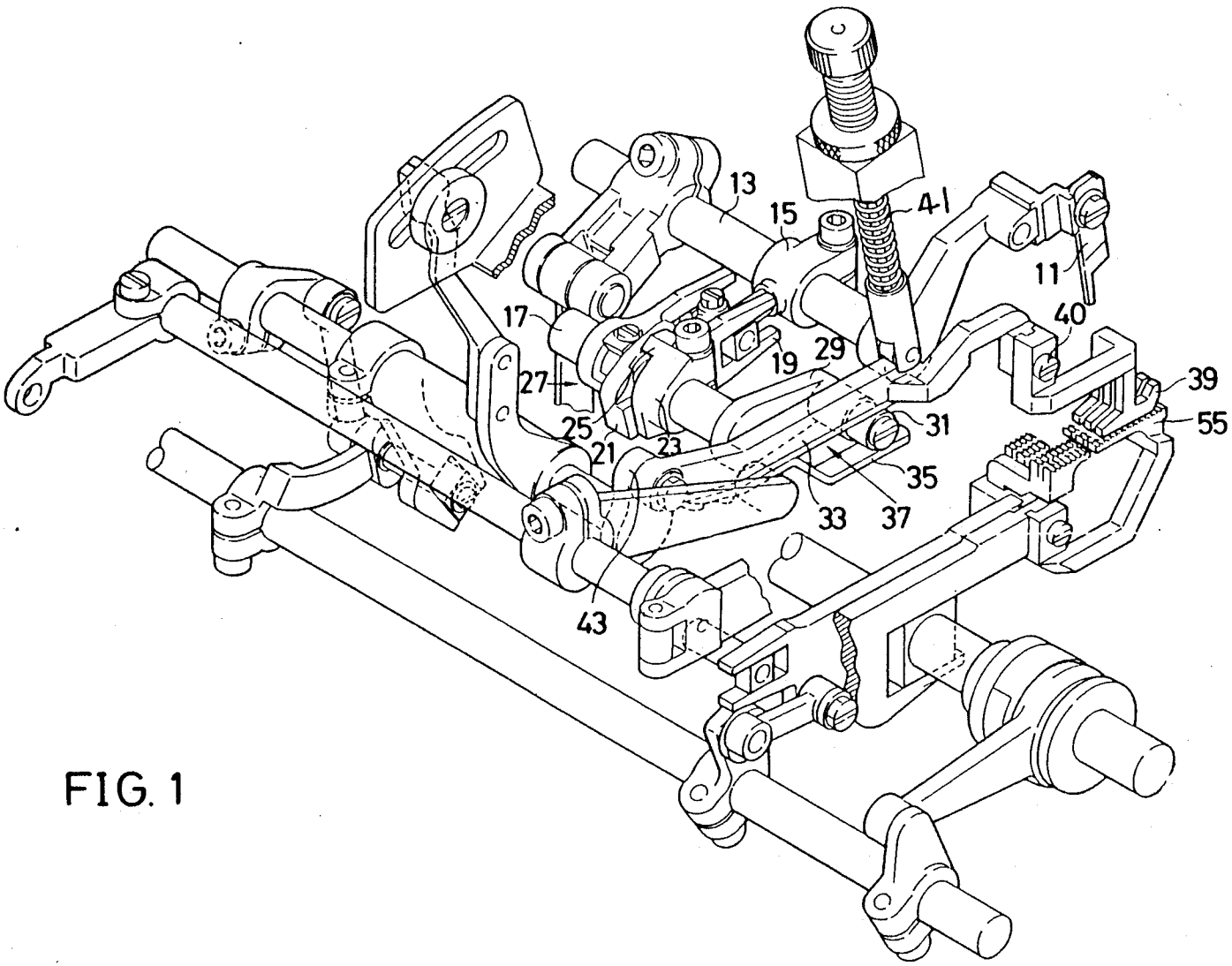
FIG. 1 is a perspective view of an upper feed device for a sewing machine of the present invention.

In the upper feed device shown in FIG. 1, the swinging of a crank 15, affixed on an upper knife shaft 13 for moving an upper knife 11 vertically, is transmitted to a bifurcate lever 19, which is rotatably supported on a vertical feed shaft 17, through a slider crank mechanism, and the vertical feed shaft 17 is oscillated through a clutch mechanism 27 having an abutment 21 at the boss part of the bifurcate lever 19 and an abutment 25 of a collar 23 affixed on the vertical feed shaft 17, thereby vertically oscillating a crank 29 affixed on the shaft end.

In the crank 29, a roller 31, pivoted on a crank pin, slidably fits in a guide groove 37 formed by upper feed arm 33 and guide 35 disposed parallel to its lower side, and by its swinging, the upper feed arm 33 is moved vertically, in collaboration with a spring device 41 for pushing down the upper feed arm, and at its front end an upper feed dog 39 is installed so as to be adjusted in position by a screw 40 driven into the upper feed arm 33 through a lengthwise running slot (not shown).

In this way, the upper feed dog 39 moves vertically by the swinging of the crank 29, and its longitudinal motion is effected by the longitudinal swinging of the crank 43 pivoting the upper feed arm 33.

Figure 2:
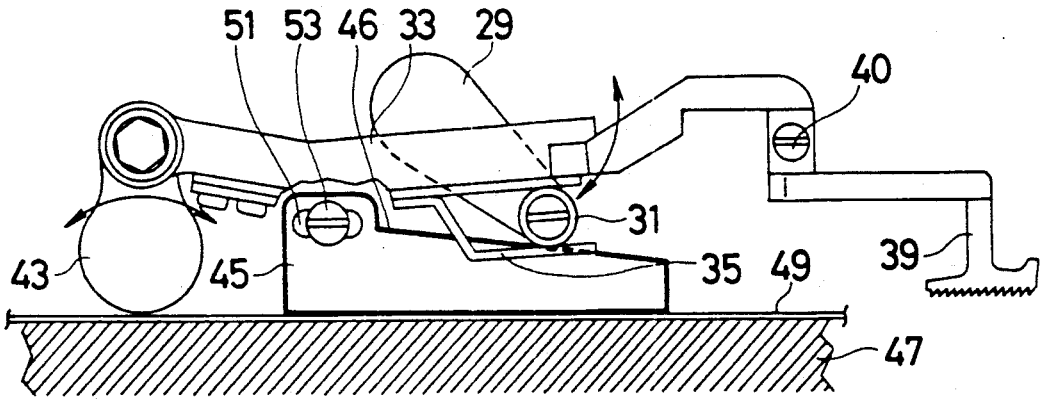
FIG. 2 is a side view of essential parts of an upper feed device for a sewing machine of the present invention.

In the thus composed upper feed device, below the roller 31 pivoted on the crank pin, as shown in FIG. 2, a block 45, as a descent-arresting means, is mounted on a felt 49 on a bed 47 of the sewing machine. When the crank 29 descends to an end point, the block 45 engages with the free end lower surface of the crank 29, thereby preventing the further descent of the roller 31 and the crank 29. When the lowering has stopped, the abutment 21 of the clutch mechanism 27 releases from abutment 25.

The block 45 responsible for defining the lowering of the roller 31 has a downwardly sloping upper surface 46 as the plane of action, and is designed to be adjusted longitudinally in its mounting position by a screw 53, driven into a sewing machine frame (not shown), within a range defined by a slot 51 in the lengthwise direction, so that the lower limit of the swinging of the crank 29 may be freely adjusted by the adjustment of the block's 45 longitudinal position.

In the foregoing embodiment, although the block 45 has a downwardly sloping upper surface as the plane of action which engages with the free end lower surface of the crank 29, the upper surface may also be upwardly sloping or be curved, or may engage with the collar affixed to the crank, the upper feed arm or the vertical feed shaft.

Figure 3:
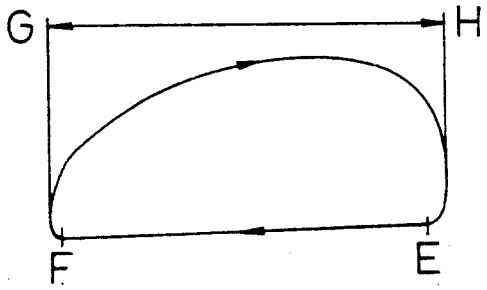
FIG. 3 is a motion diagram of an upper feed dog of an upper feed device for a sewing machine of the present invention.
Figure 7:
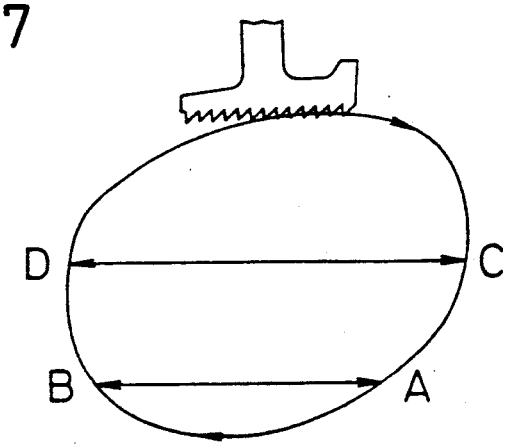
FIG. 7 is a motion diagram of a conventional upper feed dog.

The device is thus composed, and the upper feed dog for making four ellipsoidal motions consisting of longitudinal movements and vertical movements is arrested in its descending motion, as shown in FIG. 3, as the free end lower surface of the crank 29 engages with the block 45, and then moves nearly in a horizontal track, and its feed action section EF is nearly the same in length as the total motion GH in the longitudinal direction of the upper feed dog 35, so that the cloth may be fed at a high feed efficiency. Additionally, if the feed efficiency is raised, the upper feed dog 35 does not descend below a specified height, and engagement with the lower feed dog 55 does not become stronger, so that the cloth may not be damaged.

Figure 4:
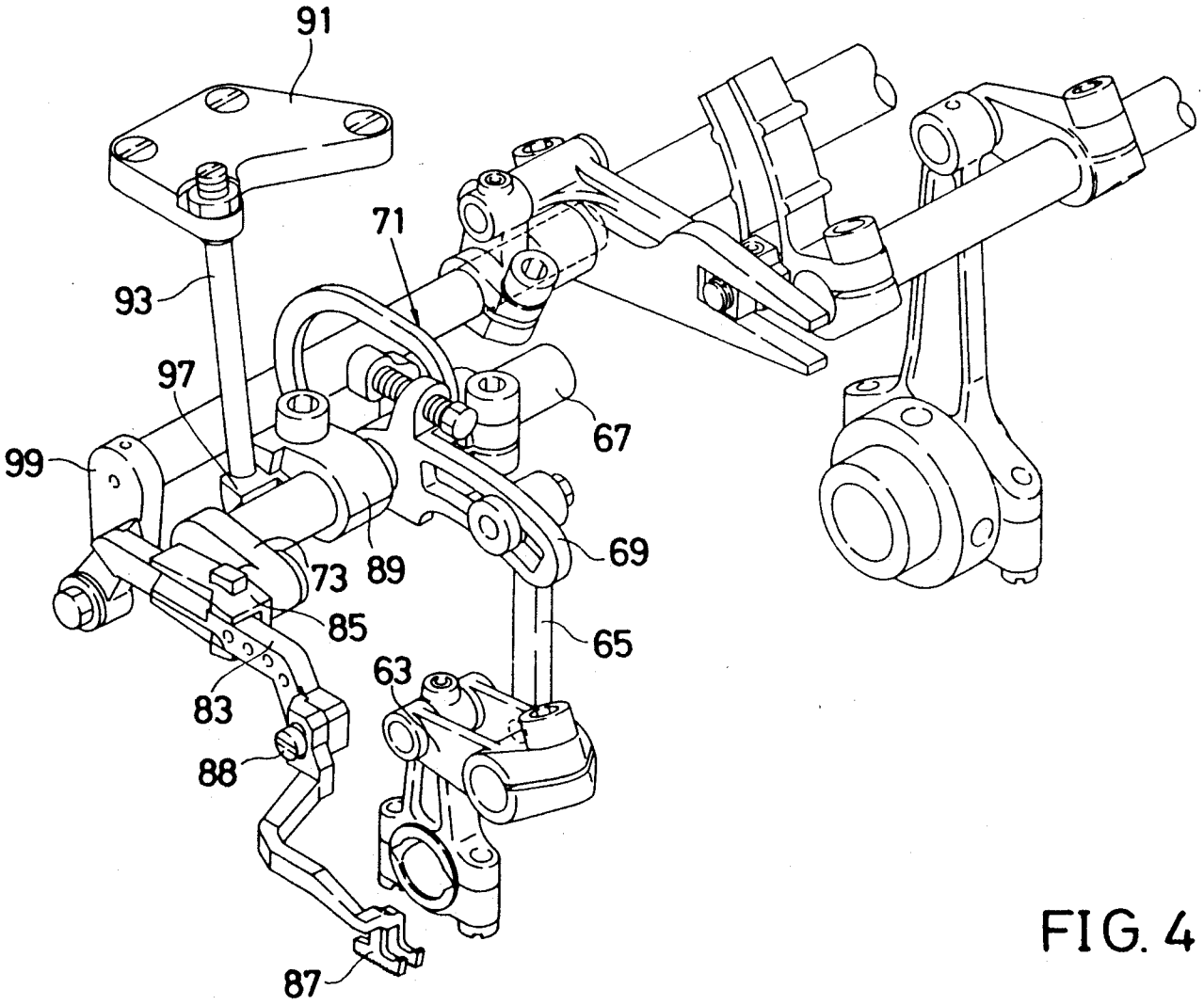
FIG. 4 is a perspective view of another embodiment of an upper feed device for a sewing machine of the present invention.
Figure 5:
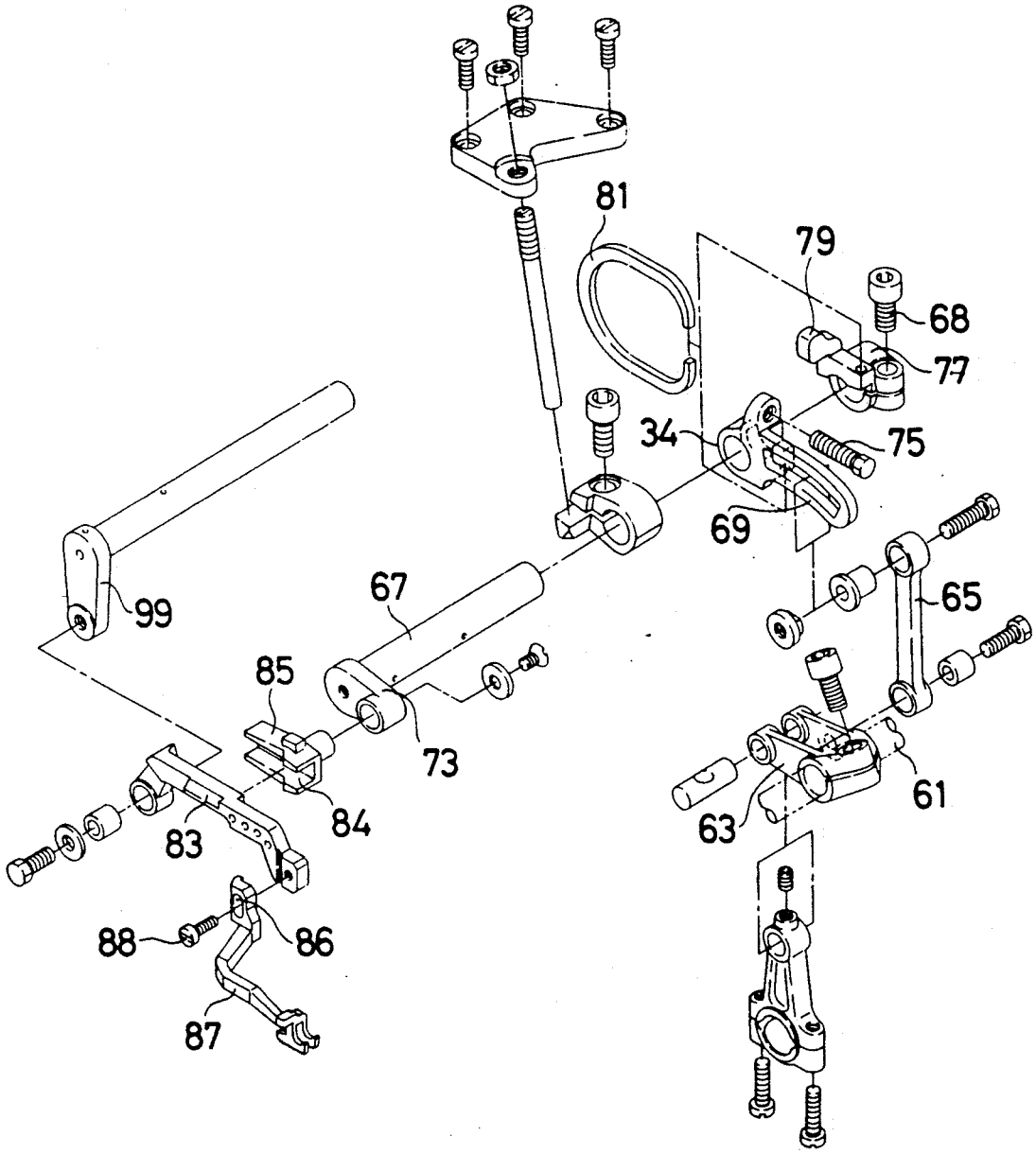
FIG. 5 is an exploded perspective view of a mechanism for moving the upper feed arm vertically of the upper feed device shown in FIG. 4.

In the upper feed device shown in FIG. 4 and FIG. 5, the swinging of a knife lever 63, affixed to an upper knife shaft 61, is transmitted to a lever 69 which is rotatably supported on a vertical feed shaft 67 through a rod 65, and the lever 69 transmits its swinging to the vertical feed shaft 67 through a clutch mechanism 71, thereby swinging the crank 73 attached at its shaft's end.

The clutch mechanism 71 comprises, as shown in FIG. 5, an adjusting screw 75 driven into lever 69, an abutment 79 of a collar 77 affixed to the vertical feed shaft 67 by screw 68, and a C-spring 81 couples the lever 69 and collar 77 and presses the projecting end of the adjusting screw 75 to the abutment 79 of the collar 77. When the lever 69 is rotated downward against the action of the spring 81, when the collar 77 stops still, the adjusting screw 75 separates from the abutment 79. The spring force of the spring 81 can be adjusted by driving the adjusting screw 75 and varying its extent of projection.

The crank 73 rotatably pivots a guide 85 having a guide groove 84 slidably engaged with an upper feed arm 83. The upper feed arm 83 is moved vertically by the swinging of the crank 73. An upper feed dog 87 is attached to the front end of the upper feed arm 83 and is adjustable in position by a screw 88 driven into the upper feed arm 83 through a lengthwise extending slot 86.

Figure 6:
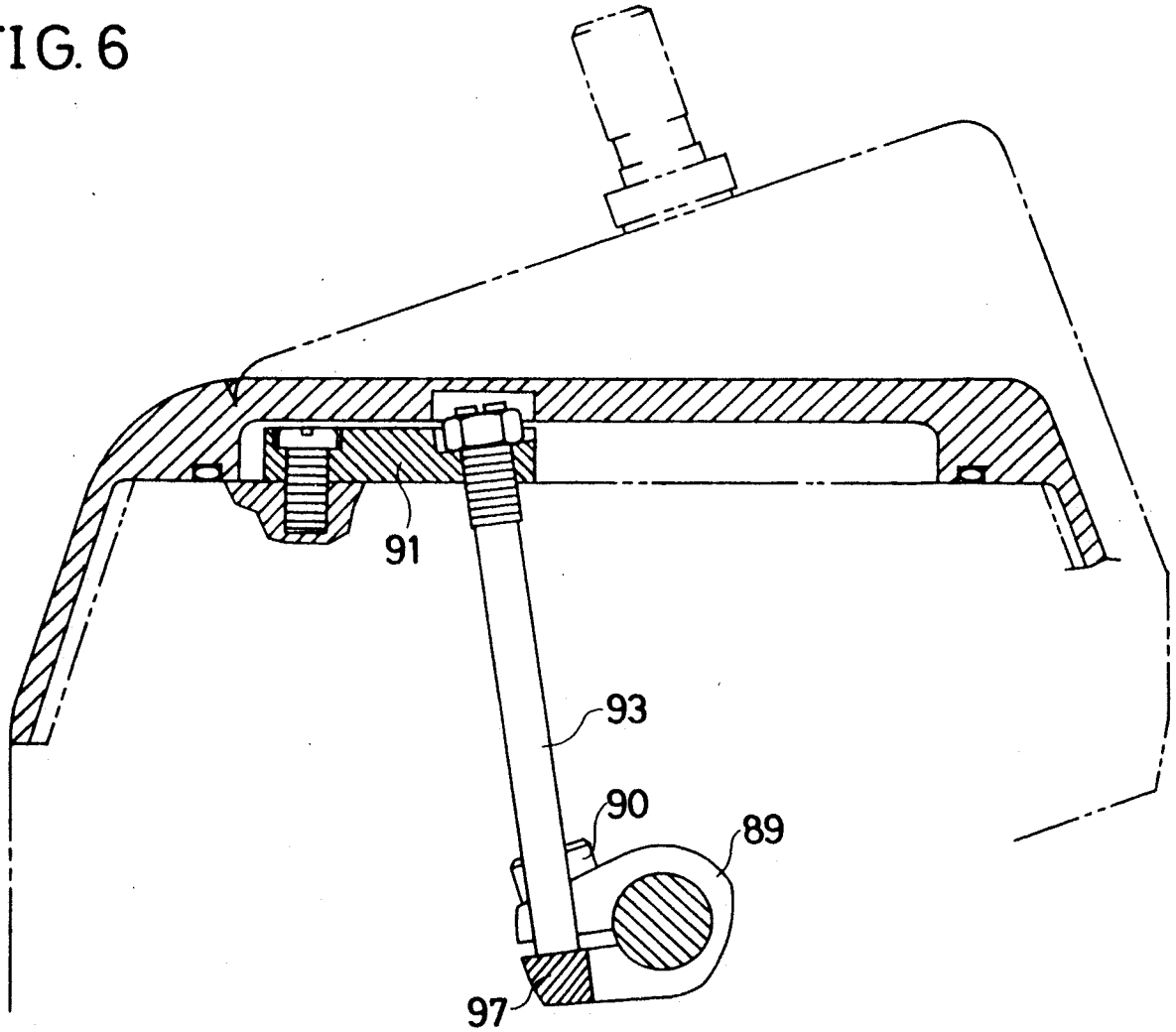
FIG. 6 is a sectional view of the upper feed device shown in FIG. 4.

A collar 89 is attached to the vertical feed shaft 67 through a screw 90 as shown in FIG. 6. A rod 93, adjustably supported on the sewing machine frame 91 in its mounting position, engages with an abutment 97 of collar 89 to prevent the collar 89, that is, the crank 73, from rotating more than specified, so that the upper feed dog 87 may not descend below a specified height. The abutment 97 of the collar 89, comprising the descent arresting means together with the lower end of the rod, may be replaced by the abutment 79 of the collar 77, or the collar 77 or a member mounted on the vertical feed shaft may be used.

The vertical motion of the upper feed dog 87 is effected in this way, and its longitudinal movement is effected by the longitudinal swinging of the crank 99 pivoting the upper feed arm 83.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An upper feed device for a sewing machine, said upper feed device comprising an upper feed arm having a base end linked to a horizontally swinging crank which swings about a horizontal axis in a longitudinal direction and a front end having an upper feed dog attached thereto, a vertical motion mechanism also linked to said upper feed arm and comprising a crank which swings vertically about a horizontal axis in cooperation with a main shaft and means for disconnecting the cooperation between the main shaft and the crank and descent arresting means comprising a block provided on a bed of said sewing machine for preventing the upper feed dog from descending more than a specified amount.

2. An upper feed device for the sewing machine of claim 1, wherein the block is installed below the upper feed arm.

3. An upper feed device for the sewing machine of claim 2, wherein the block has an inclined or curved upper surface as the plane of action and the mounting position thereof is adjustable.

4. An upper feed device for the sewing machine of claim 1, wherein the block is installed below a vertically moving member provided in the vertical motion mechanism.

5. An upper feed device for the sewing machine of claim 1, wherein the rod is adjustably supported on the sewing machine frame.

6. An upper feed device for the sewing machine of claim 1, wherein the upper feed dog is vertically adjustably affixed on the upper feed arm.

7. An upper feed device for a sewing machine, said upper feed device comprising an upper feed arm having a base end linked to a horizontally swinging crank which swings about a horizontal axis in a longitudinal direction and a front end having an upper feed dog attached thereto, a vertical motion mechanism also linked to said upper feed arm and comprising a crank which swings vertically about a horizontal axis in cooperation with a main shaft and means for disconnecting the cooperation between the main shaft and the crank and descent arresting means including an end of a rod mounted vertically on a sewing machine frame, the rod end being disposed within a range of motion of a part vertically adjustably affixed on a member comprising the vertical motion mechanism.

8. An upper feed device for the sewing machine of claim 7, wherein the rod is adjustably supported on the sewing machine frame.

9. An upper feed device for a sewing machine, said upper feed device comprising an upper feed arm having a base end linked to a longitudinally swinging crank which swings about a horizontally axis in a longitudinal direction and a front end having an upper feed dog attached thereto, a vertical motion mechanism also linked to said upper feed arm and comprising a crank which swings vertically about a horizontal axis in cooperation with a main shaft and means for disconnecting the cooperation between the main shaft and the crank and descent arresting means including an end of a rod mounted vertically on a sewing machine frame, the rod end being disposed within a range of motion of a vertically moving member comprising the vertical motion mechanism.

10. An upper feed device for the sewing machine of claim 9, wherein the rod is adjustably supported on the sewing machine frame.

* * * * *

UNITED STATES PATENT AND TRADEMARK OFFICE

CERTIFICATE OF CORRECTION

PATENT NO. : 5 174 230

DATED : December 29, 1992

INVENTOR(S) : Kazuo NOGUCHI et al

It is certified that error appears in the above-identified patent and that said Letters Patent is hereby corrected as shown below:

Column 4, line 59; change "horizontally" to ---longitudinally---.

Signed and Sealed this

Fourth Day of January, 1994

Bruce Lehman

*Attest:*

BRUCE LEHMAN

*Attesting Officer*

*Commissioner of Patents and Trademarks*